US009780453B1

(12) United States Patent
Desclos et al.

(10) Patent No.: US 9,780,453 B1
(45) Date of Patent: Oct. 3, 2017

(54) RF CIRCUIT AND ANTENNA COMBINATION FOR BODY WEARABLE WIRELESS COMMUNICATION SYSTEMS

(71) Applicant: Ethertronics, Inc., San Diego, CA (US)

(72) Inventors: Laurent Desclos, San Diego, CA (US); Jeffrey Shamblin, San Marcos, CA (US); Yu-Li Lin, Jiaoxi Township (TW); Tzu-Ling Chiu, Keelung (TW)

(73) Assignee: ETHERTRONICS, INC., San Diego, CA (US)

( * ) Notice: Subject to any disclaimer, the term of this patent is extended or adjusted under 35 U.S.C. 154(b) by 0 days.

(21) Appl. No.: 14/662,209

(22) Filed: Mar. 18, 2015

Related U.S. Application Data

(60) Provisional application No. 61/955,050, filed on Mar. 18, 2014.

(51) Int. Cl.

| | |
|---|---|
| ***H01Q 1/27*** | (2006.01) |
| ***H01Q 9/04*** | (2006.01) |
| ***H01Q 1/48*** | (2006.01) |
| ***H01Q 1/22*** | (2006.01) |

(52) U.S. Cl.
CPC ..... *H01Q 9/0407* (2013.01); *H01Q 1/2283* (2013.01); *H01Q 1/273* (2013.01); *H01Q 1/48* (2013.01)

(58) Field of Classification Search
CPC ..... H01Q 1/27; H01Q 1/273; H01Q 1/2283
See application file for complete search history.

(56) References Cited

U.S. PATENT DOCUMENTS 6,888,502 B2 * 5/2005 Beigel ..... G06K 19/07762 340/572.7
7,705,787 B2 * 4/2010 Ponce De Leon ..... H01Q 1/52 343/700 MS
8,085,714 B2 * 12/2011 Sitomaniemi ..... H04W 76/045 370/235

* cited by examiner

*Primary Examiner* — Hoang Nguyen
(74) *Attorney, Agent, or Firm* — Coastal Patent Law Group, P.C.

(57) ABSTRACT

A method of configuring a small wireless communication system is described for body wearable applications where the radiated power from the antenna in the direction of the user is reduced. A method of coupling resonators, which are formed by planar conductors as well as linear conductors, is described where the resonators extend the electrical extent of the ground plane of a small circuit board resulting in improved antenna efficiency and bandwidth characteristics from an antenna coupled or connected to the ground plane. The resonators can be configured to modify the near-field distribution of the antenna radiation pattern of the antenna coupled to the small ground plane which will result in less power radiated in the volume behind the top surface of the ground plane the antenna is coupled to. A technique is also described wherein the antenna element is integrated onto the top surface of a packaged RFIC, with the RFIC containing the transceiver circuit. The technique is optimal for providing efficiency improvements for antennas on electrically small ground planes. A method of forming slots from planar conductors is described where the radiated field from the slot is combined with the radiated field from an antenna coupled to a small ground plane which can result in improved efficiency and/or modified polarization properties from the combination of antenna, resonator, and ground plane.

9 Claims, 13 Drawing Sheets

RF CIRCUIT AND ANTENNA COMBINATION FOR BODY WEARABLE WIRELESS COMMUNICATION SYSTEMS

CROSS-REFERENCE TO RELATED APPLICATIONS

This application claims benefit of priority with U.S. Provisional Ser. No. 61/955,050, filed Mar. 18, 2015, titled "RF CIRCUIT AND ANTENNA COMBINATION FOR BODY WEARABLE WIRELESS COMMUNICATION SYSTEMS"; the contents of which are hereby incorporated by reference.

FIELD OF INVENTION

This invention relates generally to the field of wireless communication. In particular, the invention relates to techniques for improving antenna system performance of antennas coupled to electrically small ground planes when implemented in wearable applications.

BACKGROUND OF THE INVENTION

Reduced size wireless communication systems designed for wearable or body worn applications are gaining acceptance for a wide variety of applications. Medical devices which monitor a patient's health and transmit in real-time diagnostic information is one example. Another example is a tracking system comprised of a GPS receiver and a cellular transceiver packaged in a small form factor to allow for convenient and non-intrusive attachment to a person, animal, or small asset. The tracking system uses GPS to determine location which is then sent out over the cellular network to provide real-time or near real-time asset tracking. Advances in transceiver and baseband design along with reduced size RF communication circuits allow for a small communication system to be assembled on a printed circuit board (PCB) and packaged in a plastic housing to provide a small form factor, robust communication device for body worn applications. For thee cellular, WiFi, and GPS transceiver and receiver circuits a small antenna is required to transmit and receive the RF signal.

The small PCB dimensions required for a small communication system for body worn devices can cause issues in regards to antenna design, placement, and performance. Internal antennas used for wireless applications are affected by the dimensions of the ground plane that the antenna operates off of. The circuit board of the wireless device is typically used as the ground plane for the antenna. Typically the circuit board dimensions are chosen to accommodate the wireless circuit and cannot be optimized for antenna performance. For common antenna types that are used for internal antennas in wireless mobile communications such as monopoles, IFAs, PIFAs, and isolated magnetic dipoles (IMD) a ground plane that is one quarter wavelength in extent is optimal for antenna performance. Odd multiples of one-quarter wavelength will also provide for optimal impedance and efficiency characteristics for these internal antenna types. As the linear dimensions of a ground plane, the length and width, decrease below a quarter wavelength the bandwidth and the efficiency of an antenna coupled to this ground plane will decrease. When the length or width of the ground plane drops below one-tenth of a wavelength the ground plane can be designated as being electrically small. If an antenna type requires a ground plane for operation, then the bandwidth and efficiency of an antenna coupled to an electrically small ground plane will be reduced due to an inadequate electrical extent presented by the small ground plane.

When a multi-frequency band antenna is designed for use on a small ground plane, the lowest frequency band of interest will be the most impacted by the small area and small length and width provided by the ground plane. As the upper frequency bands are considered improved antenna efficiency and bandwidth will be realized compared to the lowest frequency of operation. An antenna coupled to a small ground plane has the potential of radiating a substantial amount of power behind the ground plane, due to the reduced electrical size of the ground plane. If the antenna and ground plane are positioned in close proximity to a user, as in the case of a body worn wireless communication device, a substantial portion of the radiated power can couple to the user's body. This can result in reduced communication link efficiency between the body worn communication system and the other end of the communication link such as a cellular base station or WLAN access point. This can also result in increased power absorbed by the user, which in turn results in increased Specific Absorption Rate (SAR) levels coupled.

SUMMARY

An antenna system and related method of configuring a small wireless communication system is described for body wearable applications where the radiated power from the antenna in the direction of the user is reduced. An antenna system and related method of coupling resonators, which are formed by planar conductors as well as linear conductors, is described where the resonators extend the electrical extent of the ground plane of a small circuit board resulting in improved antenna efficiency and bandwidth characteristics from an antenna coupled or connected to the ground plane. The resonators can be configured to modify the near-field distribution of the antenna radiation pattern of the antenna coupled to the small ground plane which will result in less power radiated in the volume behind the top surface of the ground plane the antenna is coupled to. A technique is also described wherein the antenna element is integrated onto the top surface of a packaged RFIC, with the RFIC containing the transceiver circuit. The technique is optimal for providing efficiency improvements for antennas on electrically small ground planes. An antenna system and related method of forming slots from planar conductors is described where the radiated field from the slot is combined with the radiated field from an antenna coupled to a small ground plane which can result in improved efficiency and/or modified polarization properties from the combination of antenna, resonator, and ground plane.

DETAILED DESCRIPTION OF EMBODIMENTS

Figure 1:
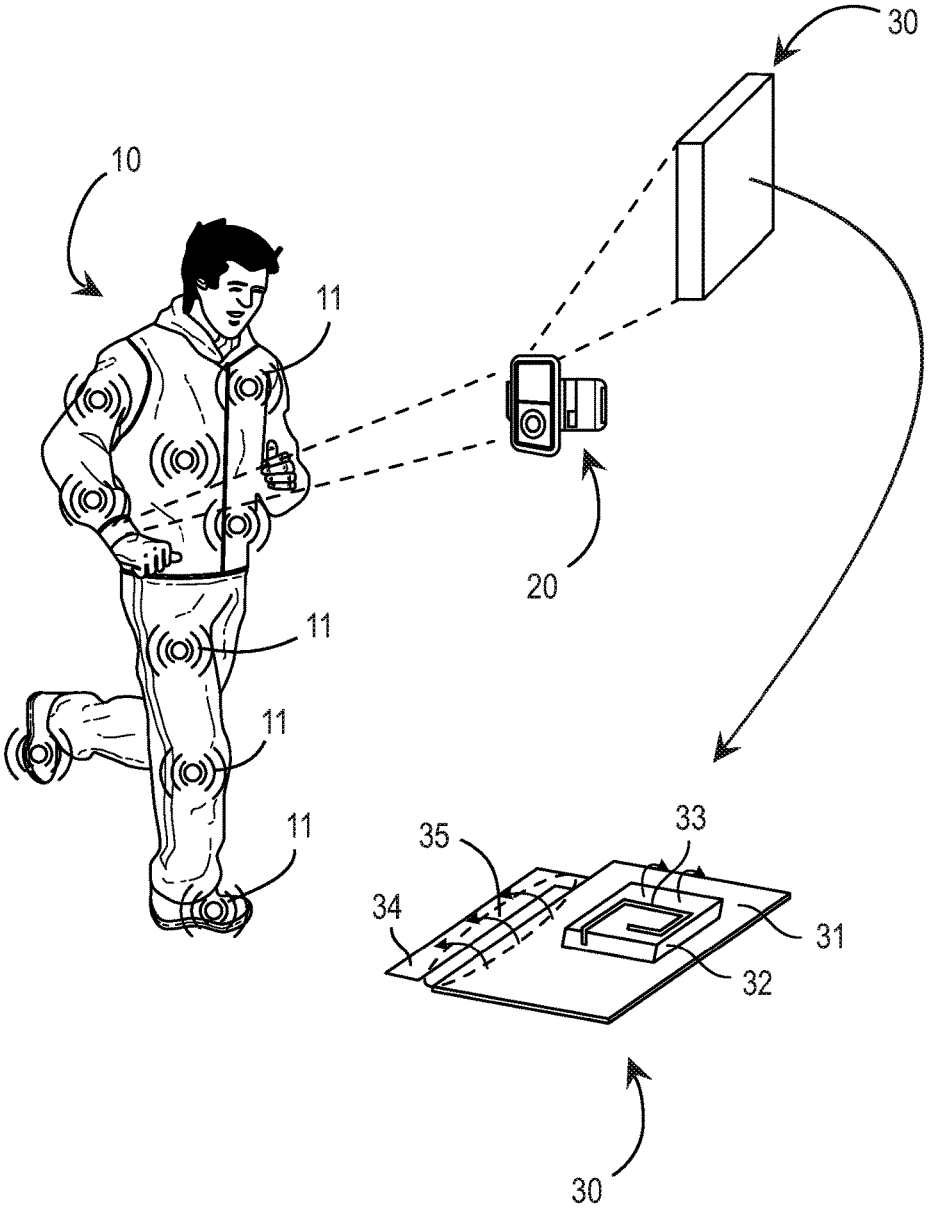
FIG. 1 illustrates a user with multiple body worn communication systems.

The disclosure concerns an antenna system and method of designing a resonator for use with an antenna coupled to a small ground plane. The resonator can be coupled or connected to either the ground plane or the antenna feed point. Also described is a method of integrating the antenna onto the top surface of a packaged radiofrequency integrated circuit (RFIC), which results in a reduced volume form factor for a wireless communication system comprised of a transceiver in RFIC form, battery, PCB, and antenna. By designing the resonator and antenna as a system or combination of elements, improved antenna efficiency can be achieved. The designing of the antenna and resonator in unison can result in a design that will couple less to the body of a user when the communication system formed by the antenna and resonator along with a transceiver on a small PCB is used in a body worn wireless application. Novel resonator and ground plan configurations are described where improved antenna performance is achieved without increasing the antenna dimensions or the ground plane dimensions.

One embodiment is described wherein a planar antenna element is designed and implemented such that it is positioned directly on top of the packaging of an RFIC. The transceiver for a wireless communication system can be designed into the RFIC and the antenna positioned on the top surface of the packaging material can be used as the antenna to connect to the transceiver for use in the wireless communication system. A reduced volume solution is obtained by the combination of the transceiver RFIC and antenna which allows for a smaller PCB. This technique will greatly aid in size reducing the wireless communication system for a body worn communication application.

Another embodiment is described wherein one end of a conductor is connected or coupled to a ground plane and the conductor is positioned in close proximity to the ground plane. An antenna is positioned on the top surface of the transceiver RFIC package, with this transceiver/antenna assembly connected or coupled to the ground plane of the PCB. The second end of the conductor is not connected to either the ground plane or the antenna, but is left disconnected. The length of the conductor and the proximity of the conductor in relation to the ground plane is chosen to increase the impedance match and/or bandwidth characteristics of the antenna connected or coupled to the ground plane. Also proper placement and excitation of the conductor can reduce the near-field EM (electromagnetic) distribution behind the ground plane to minimize coupling of power to objects in the region behind the ground plane. This is achieved by forming a slot region between the conductor and an edge or multiple edges of the ground plane. The slot can be enclosed on both edges or can be open on one side. Proper placement of the conductor and dimensioning of the conductor to control the length of the slot will result in a strong electric field distribution in the slot region, with the electric field components predominantly formed in the plane of the ground plane. More power will be coupled to the slot region and radiated and less power will be directly radiated by the antenna element, resulting in less power coupled to a user positioned directly behind the ground plane.

Another embodiment is described wherein the conductor is connected or coupled to the ground plane, and a transceiver/antenna assembly is connected or coupled to the same ground plane of the PCB. The conductor is positioned in proximity to the antenna element to allow for the antenna to induce a current directly onto the conductor. The induced current on the conductor alters the current density on the ground plane. Proper selection of the conductor length, position to the antenna, and grounding location on the ground plane results in increased antenna efficiency, impedance match, and/or bandwidth. Again, as previously described, proper placement and excitation of the conductor can reduce the near-field EM (electromagnetic) distribution behind the ground plane to minimize coupling of power to objects in the region behind the ground plane. This is achieved by forming a slot region between the conductor and an edge or multiple edges of the ground plane.

In another embodiment, one end of a conductor is connected or coupled to the feed point of an antenna, with the antenna positioned on the top surface of the packaging of the transceiver RFIC and the transceiver/antenna assembly connected or coupled to a ground plane of the PCB. The second end of the conductor is not connected to either the ground plane or antenna. The conductor can be positioned in close proximity to the ground plane to minimize the increase in volume of the ground plane/antenna/conductor assembly. Excitation of the antenna in either the transmit or receive mode results in RF currents flowing on the connected or coupled conductor. The conductor provides the mechanism of increasing the antenna aperture.

In another embodiment, the conductor can be configured in a planar fashion to increase the cross sectional area available for current flow. One end of the planar conductor is connected to the ground plane with a major portion of the planar conductor running along one edge of the ground plane, forming a slot region between the planar conductor and the ground plane. The slot formed by the planar conductor and the ground plane is dimensioned and positioned in relation to the antenna that is coupled or connected to the ground plane to support an electric field distribution that radiates. Proper antenna design and slot design can result in improved total radiation performance from the antenna, resonator, ground plane combination.

In another embodiment, a planar conductor can be configured to form a slot with the ground plane and an antenna coupled or connected to the ground plane can be positioned to optimally excite an electric field distribution in the slot region. The slot can be positioned along one or multiple sides of a square, rectangular, triangular shaped PCB such that the polarization state of the radiation from the slot is different than the polarization state of the antenna coupled to the ground plane. The resultant composite radiated field will provide far-field components with elliptical or circular polarization.

Now turning to the drawings, FIG. 1 illustrates a user 10 with multiple body worn communication systems 11. A wireless communication device 20 in the form of a wristwatch is shown. Also show is a transceiver 30 with antenna in module form and in detail. The detailed illustration shows an antenna 33 integrated on the transceiver packaging 32, an electrically small PCB 31 with ground plane layer, and a resonator 34 which forms a slot region in conjunction with the PCB. An electric field distribution 35 is contained in the slot region.

Figure 2:
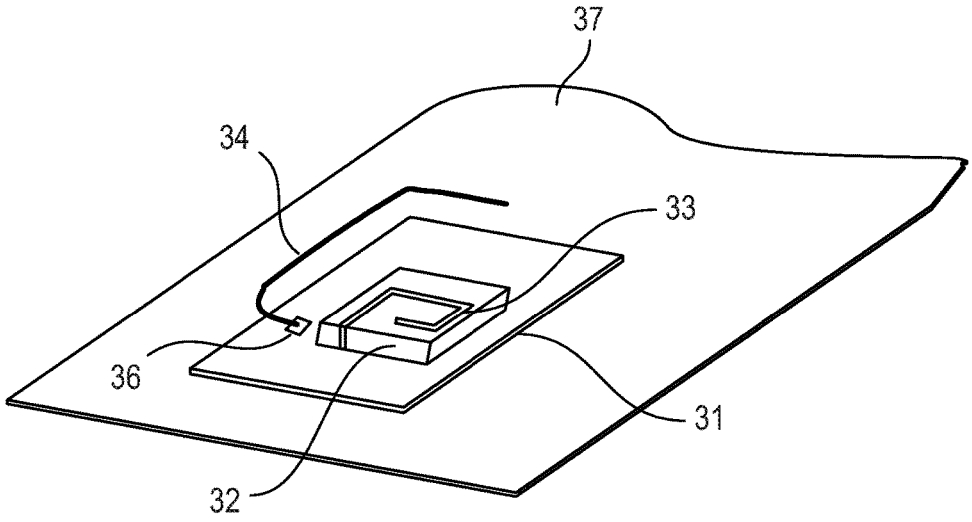
FIG. 2 illustrates an antenna with a resonator coupled to a ground plane to optimize current flow from the induced fields of the radiating antenna.

FIG. 2 illustrates an antenna 33 connected to an electrically small circuit board with ground plane 31. A transceiver chipset 32 is connected to the feed point of the antenna. One end of a conductor 34 is connected to the ground pad 36 of the ground plane and the second end of the conductor is left un-terminated. The conductor is positioned external to one or several edges of the ground plane 31. The electrically small circuit board with ground plane is disposed on a portion of a user's body 37 or other object which the antenna system is positioned near. In this regard, the resonator is coupled to the ground plane to optimize current flow from induced fields from the radiating antenna. The antenna is integrated onto the transceiver chipset to reduce overall device size.

Figure 3:
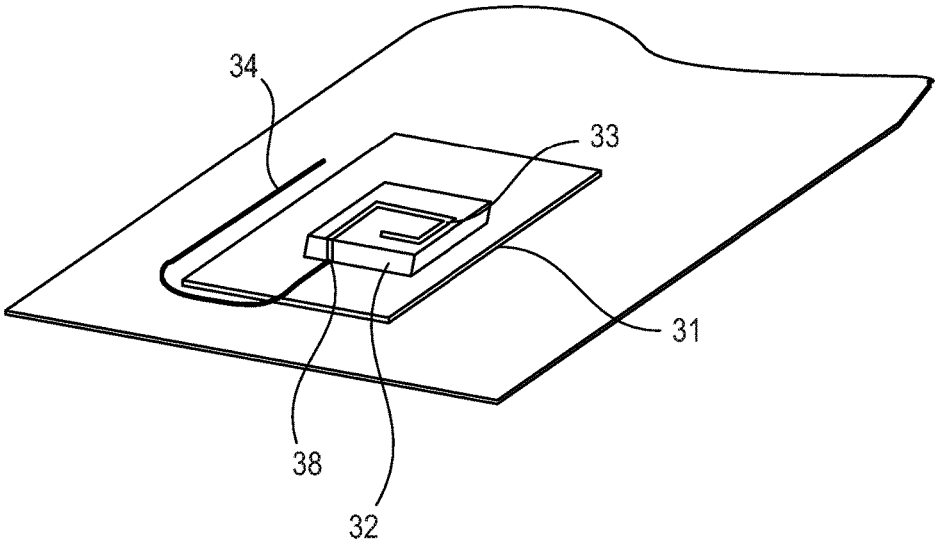
FIG. 3 illustrates an antenna with a resonator coupled to an antenna feed to contain electric field distribution to the plane of the circuit board.

FIG. 3 illustrates an antenna 33 connected to an electrically small ground plane 31. A transceiver chipset 32 is connected to the feed point 38 of the antenna. One end of a conductor 34 is connected to the feed point 38 of the antenna and the second end of the conductor is left un-terminated. The conductor 34 is positioned external to one or several edges of the ground plane 31. The conductor being coupled to the feed point of the antenna can be referred to as a "resonator", and the resonator is coupled to the antenna feed to contain the electric field distribution to the plane of the circuit board and to increase the electrical length of the antenna.

Figure 4:
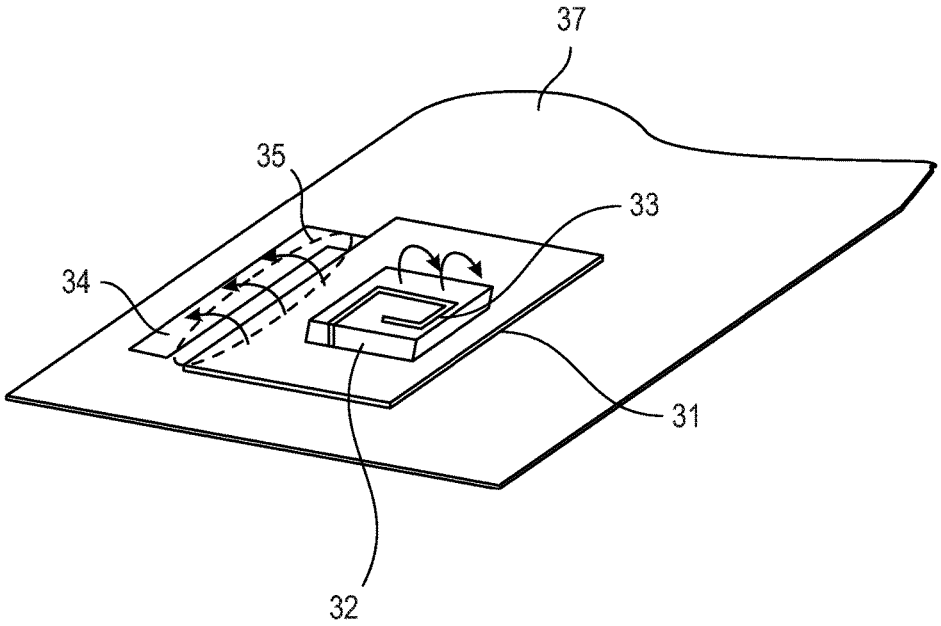
FIG. 4 illustrates an antenna with a resonator coupled to the ground plane to alter current distribution by generating a resonant slot.

FIG. 4 illustrates an antenna 33 connected to an electrically small ground plane 31. A transceiver chipset 32 is connected to the feed point of the antenna. One end of a planar conductor 34 is connected to the ground of the ground plane 31 and the second end of the planar conductor is left un-terminated. The planar conductor is positioned parallel to one or several edges of the ground plane, with a slot region being formed by the planar conductor and ground plane. An electric field distribution 35 is generated in the slot region when the antenna is excited.

Figure 5:
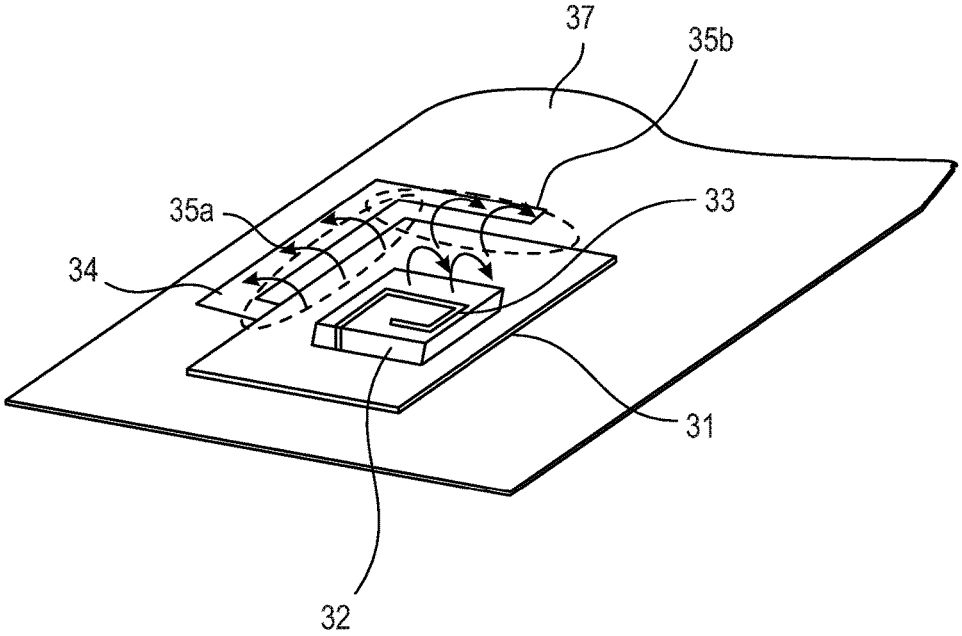
FIG. 5 illustrates an antenna with an alternate slot placement in relation to the antenna.

FIG. 5 illustrates an antenna 33 connected to an electrically small ground plane 31. A transceiver chipset 32 is connected to the feed point of the antenna. One end of a planar conductor 34 also referred to as a "resonator" is connected to the ground of the ground plane 31 and the second end of the planar conductor is left un-terminated. The planar conductor 34 is positioned parallel to one or several edges of the ground plane 31, with a slot region being formed by the planar conductor 34 and ground plane 31. The planar conductor 34 is positioned in close proximity to the antenna 33 to provide for improved coupling of the antenna to the planar conductor. An electric field distribution 35*a*; 35*b* is generated in the slot regions when the antenna is excited. The slots are designed to be placed with relation to the antenna. Radiation from the resonant slot regions combine with the radiated fields of the antenna.

Figure 6:
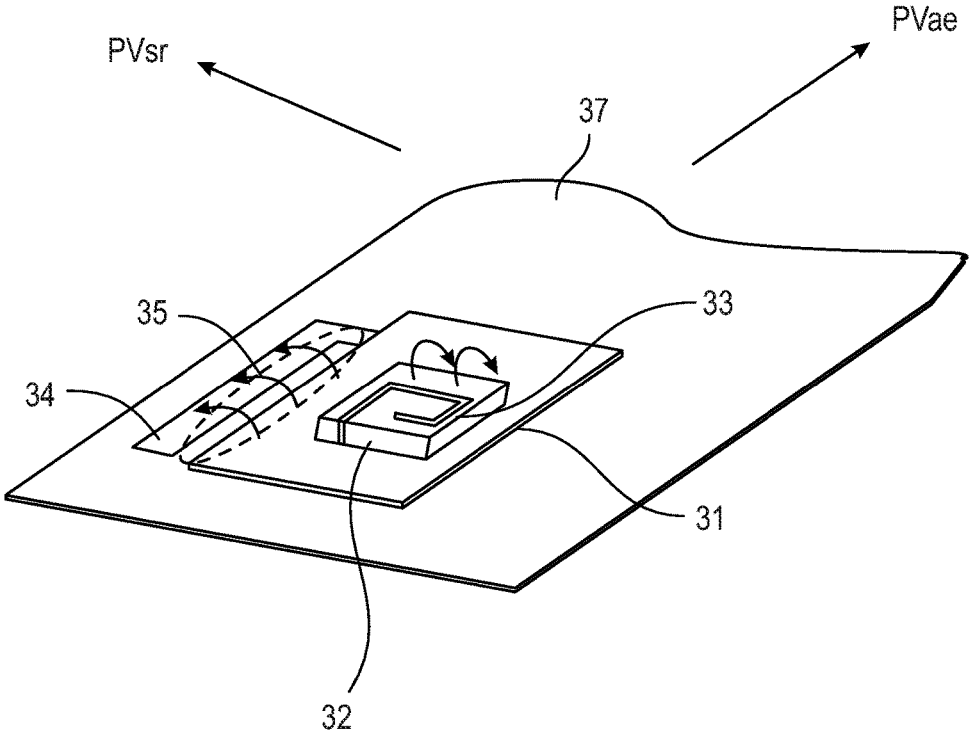
FIG. 6 illustrates an antenna with a slot created by the planar resonator and ground plane positioned to provide an alternate polarization compared to the antenna element.

FIG. 6 illustrates an antenna 33 connected to an electrically small ground plane 31. A transceiver chipset 32 is connected to the feed point of the antenna. One end of a planar conductor 34 is connected to the ground of the ground plane 31 and the second end of the planar conductor is left un-terminated. The planar conductor is positioned parallel to one edge of the ground plane, with a slot region being formed by the planar conductor 34 and ground plane 31. An electric field distribution 35 is generated in the slot regions when the antenna is excited. Radiation from the slot region has a polarization state (PVsr) that is different from the polarization state from the antenna (PVae). The slot created by the planar conductor 34 and ground plane 31 is positioned to provide an alternate polarization compared to the polarization of the antenna element. The radiation from the resonant slot combines with the radiated fields of the antenna.

Figure 7A:
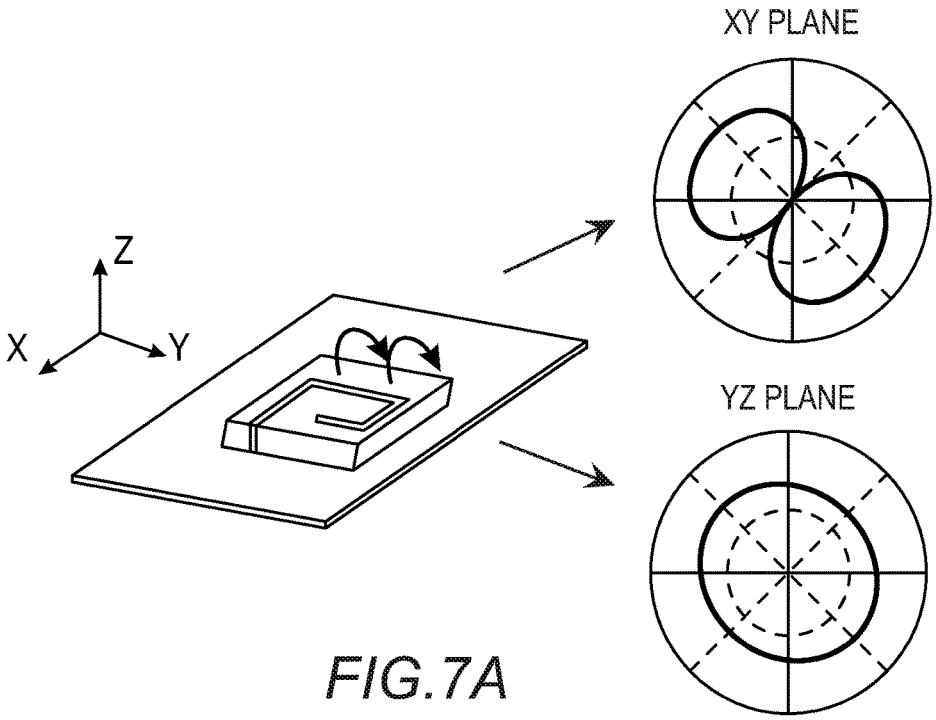
FIG. 7A shows the radiation patterns of an antenna without a slot.
Figure 7B:
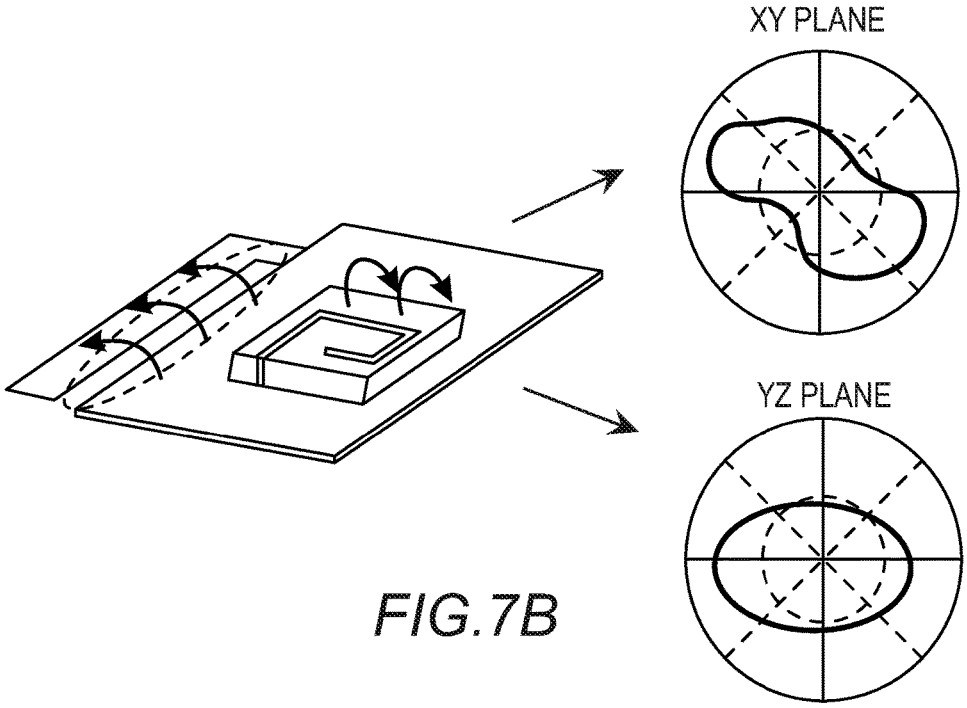
FIG. 7B shows the radiation patterns of the antenna as altered by introduction of a slot.

FIG. 7A illustrates the radiation pattern generated from an antenna integrated into the packaging of an RFIC, with RFIC and antenna connected to a small PCB. Also illustrated in FIG. 7B is the radiation patterns generated when a resonator is applied to the assembly and a slot is formed and an electric field distribution is contained in the slot region.

Figure 8:
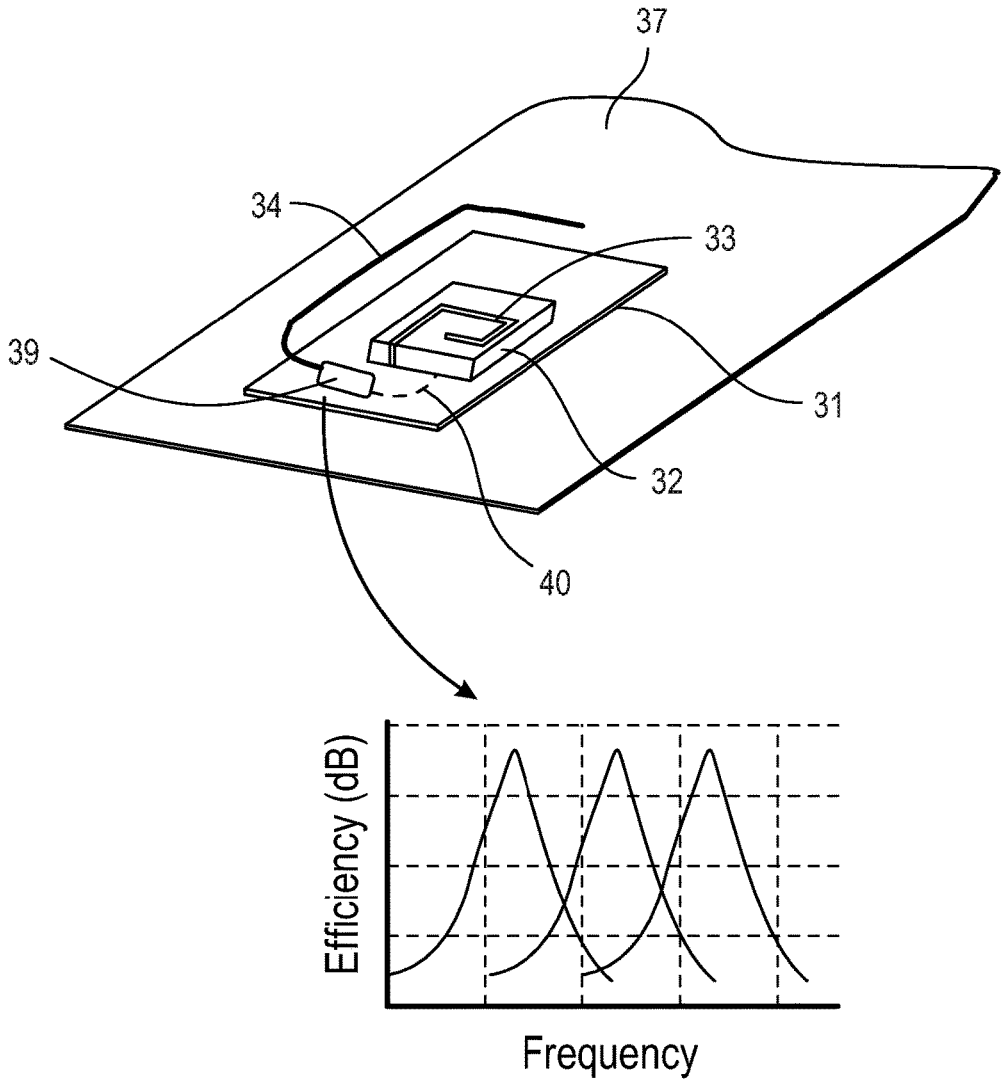
FIG. 8 illustrates an antenna with a tuning component used to alter the electrical length or impedance of the resonator.

FIG. 8 illustrates an antenna 33 connected to an electrically small ground plane 31. A transceiver chipset 32 is connected to the feed point of the antenna. One end of a conductor 34 is connected to the feed point of the antenna and the second end of the conductor is left un-terminated. The conductor is positioned external to one or several edges of the ground plane. A tuning component 39 is connected or coupled to the conductor 34 and is used to alter the electrical length and/or impedance of the conductor. The tuning component is shown connected to the transceiver chipset 32 via control line 40. Varying the tuning component characteristics results in a frequency shift of the radiated fields from the antenna.

Figure 9:
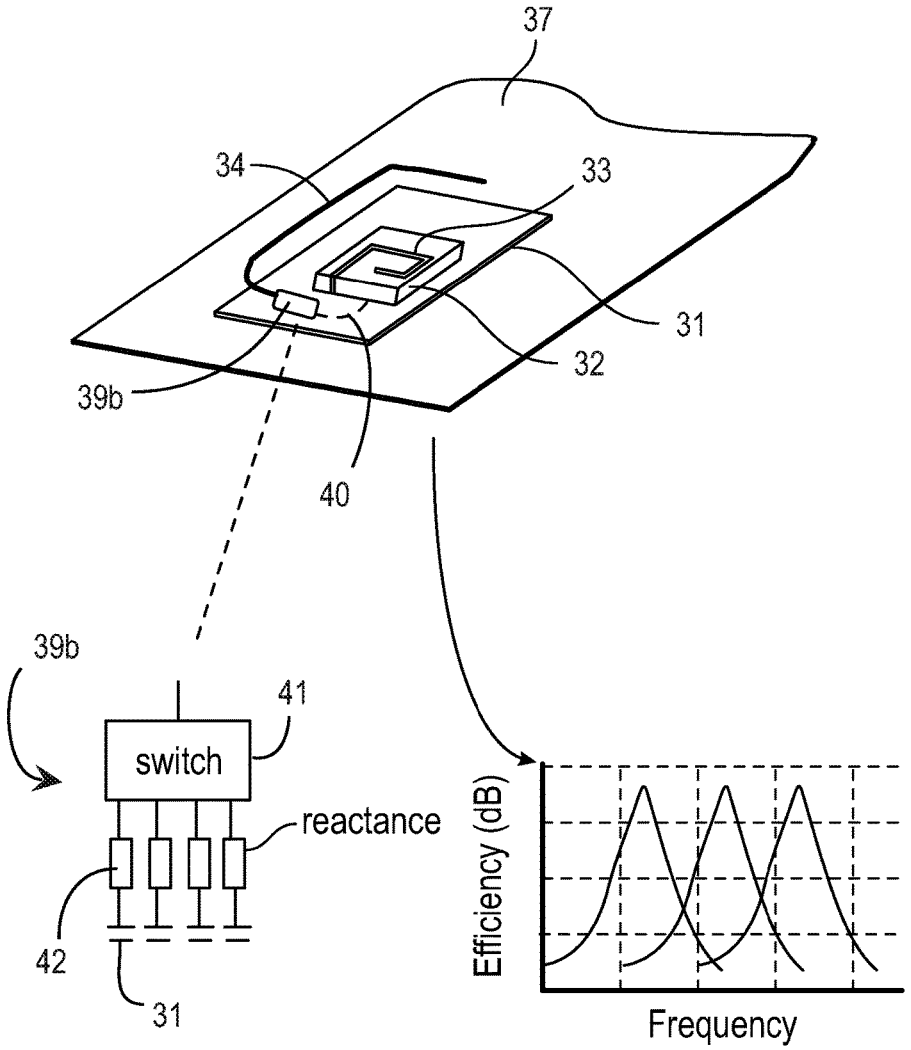
FIG. 9 illustrates an antenna wherein a switch is used to connect the resonator to ground through a lumped reactance.

FIG. 9 illustrates a tuning configuration applied to a resonator 34 which is integrated into a wireless communication system formed by an antenna 33/transceiver chipset 32 combination connected to a small PCB 31. The tuning circuit 39*b* is comprised of a four port switch 41 with reactive loads 42 attached to the four ports and the common port of the switch attached to the resonator 34. The second end of the reactive loads are each connected to ground 31. By switching from one reactive load on one port to another reactive load on a second port, the frequency response can be altered as shown in the plot of efficiency as a function of frequency. In this regard, a switch is used to connect the resonator 34 to ground 31 through a lumped reactance.

Figure 10A:
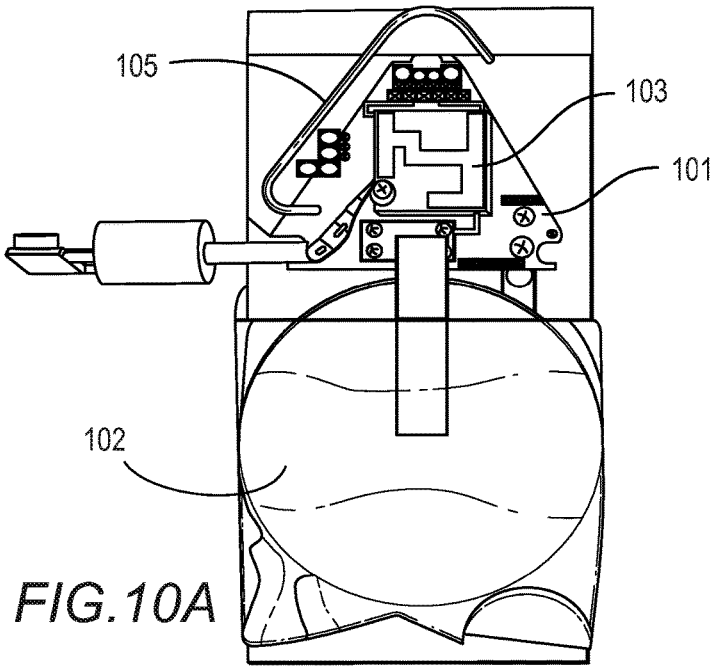
FIGS. 10(A-B) illustrate a practical implementation of a resonating element coupled to an electrically small ground plane from a top plan view and a perspective view, respectively.
Figure 10B:
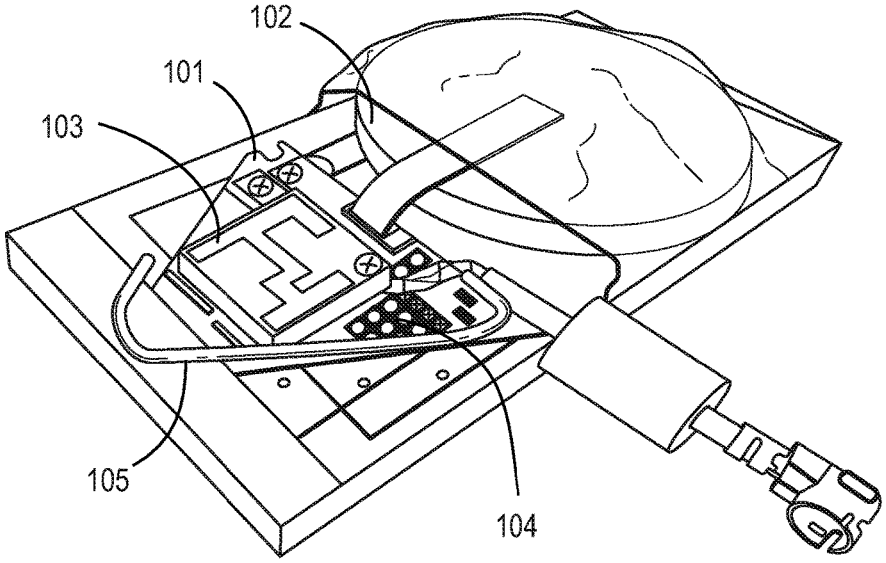

FIGS. 10(A-B) illustrate a practical implementation of a resonating element coupled to an electrically small ground plane. A triangular ground plane 101 is shown with a battery 102 connected to the circuitry on the ground plane. An antenna 103 is connected to a transceiver 104 and one end of a wire conductor 105 is connected to the ground plane.

Figure 11:
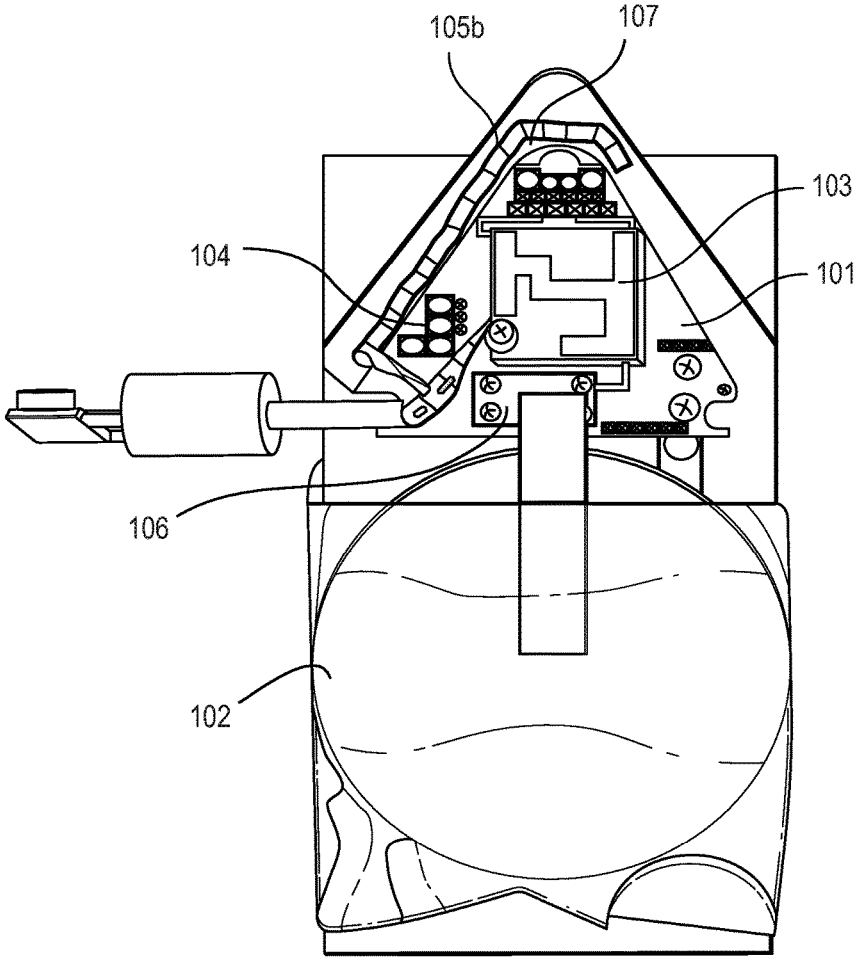
FIG. 11 illustrates a practical implementation of a resonating element coupled to an electrically small ground plane.

FIG. 11 illustrates a practical implementation of a resonating element coupled to an electrically small ground plane. A triangular ground plane 101 is shown with a battery 102 connected to the circuitry 106 on the ground plane. An antenna 103 is connected to a transceiver 104 and one end of a planar conductor 105*b* is connected to the ground plane. A slot region 107 is formed between the planar conductor and the ground plane.

Figure 12:
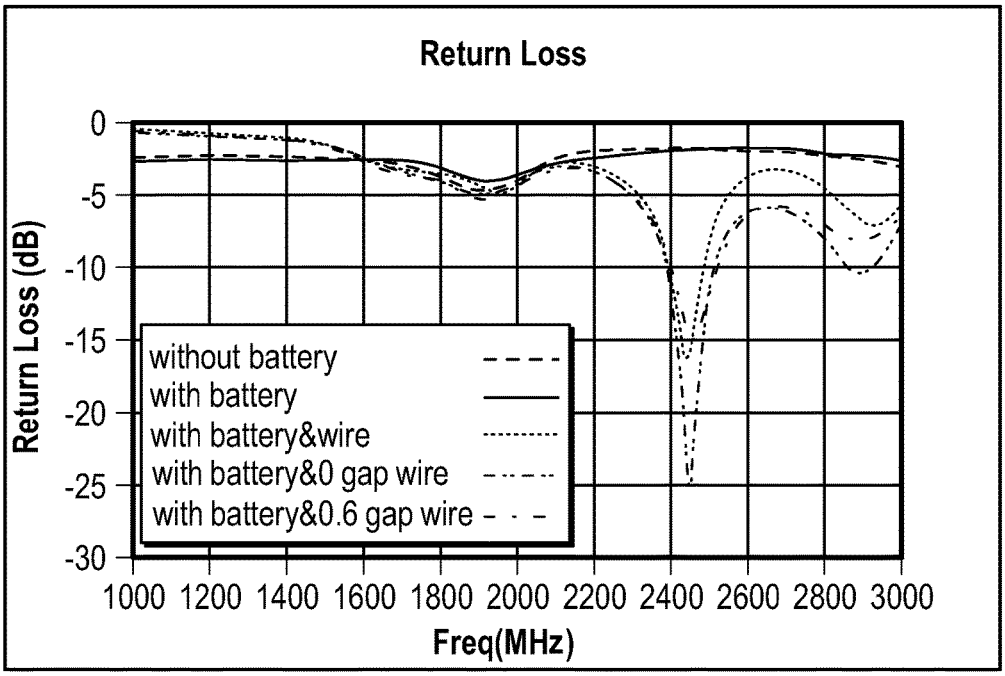
FIG. 12 shows a plot of measured return loss for several configurations of the antenna and planar conductor shown in FIG. 10.

FIG. 12 shows a plot of measured return loss for several configurations of the antenna and planar conductor shown in FIG. 10. As can be seen in the plot, the return loss is substantially improved when the wire resonator is attached to the ground plane.

Figure 13:
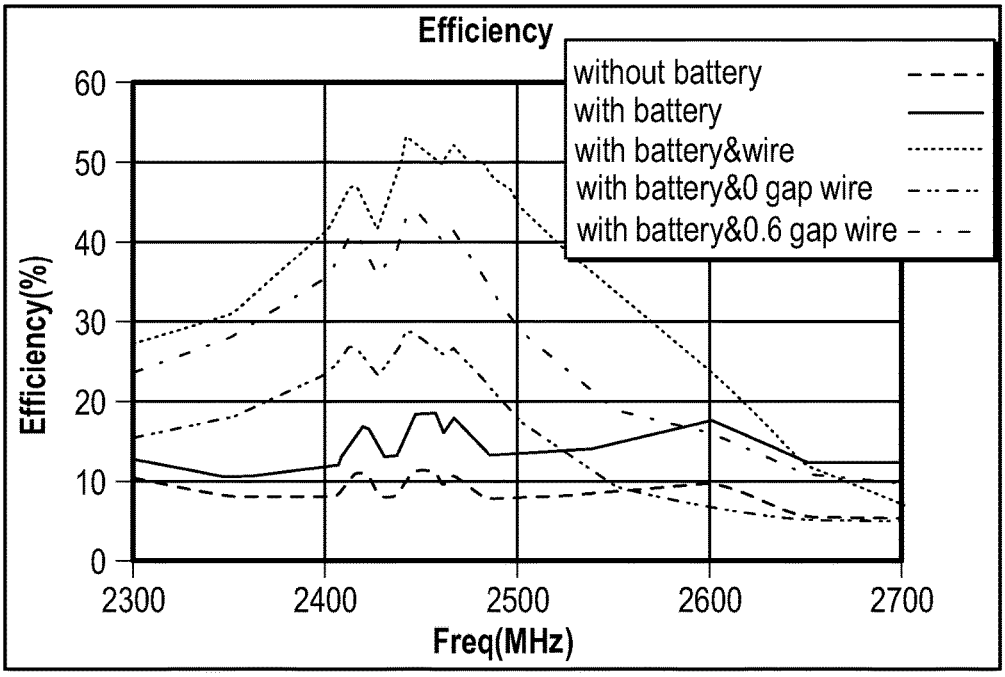
FIG. 13 shows a plot of measured efficiency for several configurations of the antenna and planar conductor shown in FIG. 10.

FIG. 13 shows a plot of measured efficiency for several configurations of the antenna and planar conductor shown in FIG. 10. As can be seen in the plot, the efficiency is substantially improved when the wire resonator is attached to the ground plane.

Figure 14:
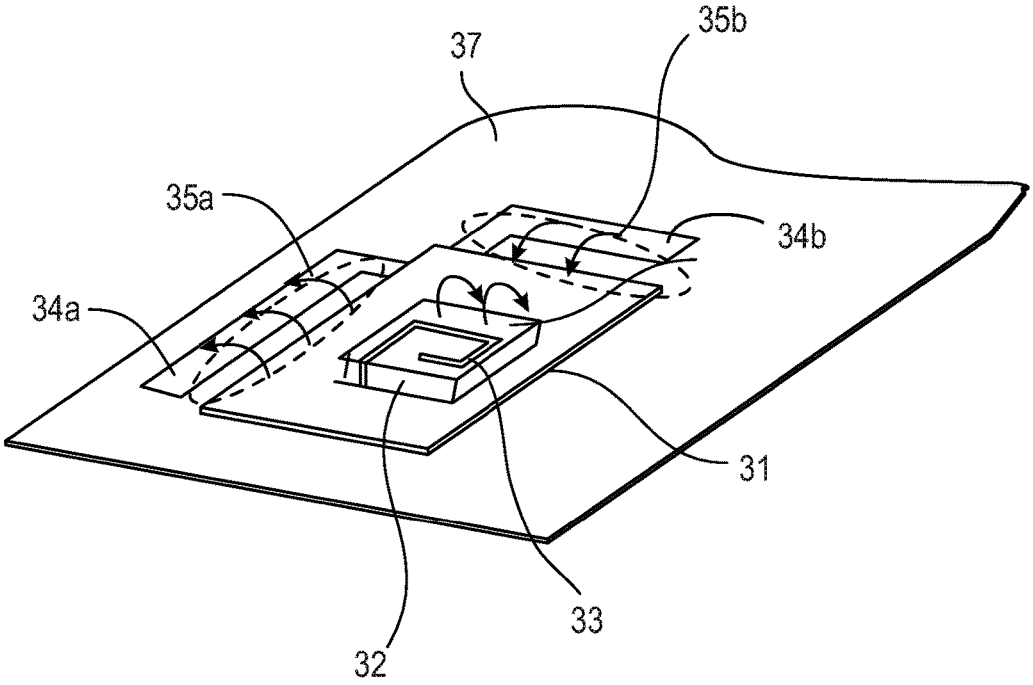
FIG. 14 illustrates a two slot configuration where two planar conductors are used to form two slot regions to shape the radiated field characteristics.

FIG. 14 illustrates a two slot configuration where two planar conductors are 34*a*; 34*b* used to form two slot regions to shape the radiated field characteristics. Shown is an electrically small ground plane 31; a transceiver chipset 32; antenna 33; first planar conductor 34*a*; first electric field 35*a*; second planar conductor 34*b*; second electric field 35*b*; and a portion of a user's body 37 or other object the antenna system is positioned near.

What is claimed is:

1. An antenna system comprising:

an integrated circuit module including an RF circuit contained within a non-conductive packaging material;

the integrated circuit module positioned on a circuit board, the circuit board having a ground plane associated therewith;

a first antenna element disposed at a top surface of the integrated circuit module; and a first planar resonator extending from the circuit board and oriented to be disposed within a common plane of the circuit board.

2. The antenna system of claim 1, wherein a portion of the first resonator is positioned along an edge of the circuit board thereby forming a slot between the circuit board and the first resonator.

3. The antenna system of claim 1, comprising two or more resonators extending from the circuit board and positioned within the common plane.

4. The antenna system of claim 1, further comprising a tunable component having a first port and a second port, the first port of the tunable component being coupled to the first resonator and the second port of the tunable component being coupled to the ground plane; wherein the tunable component comprises a tunable capacitor, tunable inductor, single-port switch, multi-port switch, or a diode.

5. The antenna system of claim 1, wherein the first planar resonator is coupled to the ground plane.

6. The antenna system of claim 1, wherein the first planar resonator is coupled to the ground point associated with the first antenna element.

7. The antenna system of claim 1, wherein the first antenna element is integrated into the top surface of the integrated circuit module.

8. An antenna system comprising:

an integrated circuit module including an RF circuit contained within a non-conductive packaging material;

the integrated circuit module positioned on a circuit board, the circuit board having a ground plane associated therewith;

a first antenna element disposed at a top surface of the integrated circuit module; and a first planar resonator extending from the circuit board and oriented to be disposed within a common plane of the circuit board;

wherein the first planar resonator is coupled to a feed point of the first antenna element.

9. The antenna system of claim 8, comprising two or more resonators each coupled to the feed point of the first antenna element.

* * * * *